US006364814B1

(12) United States Patent
Linton

(10) Patent No.: US 6,364,814 B1
(45) Date of Patent: Apr. 2, 2002

(54) AQUATIC EXERCISE DEVICE AND METHOD THEREFOR

(76) Inventor: Don D. Linton, 15160 N. 100 Pl., Scottsdale, AZ (US) 85260

( * ) Notice: Subject to any disclaimer, the term of this patent is extended or adjusted under 35 U.S.C. 154(b) by 0 days.

(21) Appl. No.: 09/562,656

(22) Filed: May 2, 2000

(51) Int. Cl.[7] ..... A63B 69/12
(52) U.S. Cl. ..... 482/55
(58) Field of Search ..... 482/55, 56, 148; D06/601; D24/183; 5/636, 637, 648; 601/121, 124; 441/1.8, 129, 131

(56) References Cited

U.S. PATENT DOCUMENTS 2,678,857 A * 5/1954 Hans ..... 311/10
D216,689 S * 3/1970 Isogai ..... D15/8
4,378,007 A * 3/1983 Kachadourian ..... 601/121
4,804,326 A * 2/1989 Lennon ..... 434/254
4,861,300 A * 8/1989 Casagrande et al. ..... 441/81
5,131,383 A * 7/1992 Juarez ..... 601/19
5,643,182 A * 7/1997 Engel ..... 601/119

* cited by examiner

*Primary Examiner*—Stephen R. Crow
(74) *Attorney, Agent, or Firm*—Jeffrey D. Moy; Jeffrey Weiss; Weiss & Moy, P.C.

(57) ABSTRACT

An aquatic exercise device and method therefor dimensioned to be retained between a person's thighs while swimming. By swimming with the aquatic exercise device in between a swimmer's thighs, a swimmer is able to contract his or her leg muscles against both a horizontal as well as vertical form of resistance. Through this method, the aquatic exercise device enables a swimmer to more fully build leg strength.

6 Claims, 1 Drawing Sheet

AQUATIC EXERCISE DEVICE AND METHOD THEREFOR

FIELD OF THE INVENTION

This invention relates generally to aquatic exercise devices and methods therefor and, more specifically, to a device dimensioned to be retained between a person's thighs while the person is swimming.

BACKGROUND OF THE INVENTION

Swimming, in addition to being a sport, is also a popular form of exercise. Those who swim can build muscle strength in their arms, legs, and other body parts. More specifically, leg strength is built when the leg's muscles are contracted against a form of resistance—in this case, water. However, this form of isometric exercise has several disadvantages: water alone provides only a limited form of resistance for building leg strength, and the constant angle of the kicking motion needed to propel a swimmer forward only partially develops the quadriceps, hamstrings and other leg muscles.

In order to more fully develop a muscle group, it is often necessary to contract those muscles against a form of resistance from various angles. The kicking motion in such exercises as free-style swimming and in the butterfly stroke generally only provide resistance to leg muscles across a vertical field of motion and not across a horizontal plane. Optimum muscle development can occur if the leg muscles simultaneously contract against both an up and down resistance as well as a horizontal resistance. Without a device to place between a swimmer's thighs, however, it is difficult for a swimmer to simultaneously contact the leg muscles against both a horizontal and a vertical form of resistance while swimming.

A need therefore existed for an aquatic exercise device dimensioned to be retained between a person's thighs while swimming so that a swimmer can simultaneously contract the leg muscles horizontally and vertically.

SUMMARY OF THE INVENTION

An object of the present invention is to provide an aquatic exercise device dimensioned to be retained between a person's thighs while swimming so that a swimmer can more fully build leg strength, and a method therefor.

BRIEF DESCRIPTION OF THE PREFERRED EMBODIMENTS

In accordance with one embodiment of the present invention, an aquatic exercise device is disclosed, comprising, in combination, an intermediate section having a first end and a second end, the intermediate section is comprised of a resilient material and is dimensioned to be retained between a person's thighs while the person is swimming, a first outer section attached to the first end, at least a portion of the first outer section has a width greater than a width of the intermediate section, the first outer section is dimensioned to project outward from the intermediate section and to extend at least partially from a space between the person's thighs, a second outer section attached to the second end, at least a portion of the second outer section has a width greater than a width of the intermediate section, the second outer section is dimensioned to project outward from the intermediate section and to extend at least partially from a space between the person's thighs.

In accordance with another embodiment of the present invention, a method for aquatic exercise is disclosed, comprising, in combination, the steps of providing an intermediate section having a first end and a second end, the intermediate section is comprised of a resilient material, retaining the intermediate section between a person's thighs while the person is swimming, providing a first outer section attached to the first end, at least a portion of the first outer section has a width greater than a width of the intermediate section, the first outer section is dimensioned to project outward from the intermediate section and to extend at least partially from a space between the person's thighs, providing a second outer section attached to the second end, at least a portion of the second outer section has a width greater than a width of the intermediate section, the second outer section is dimensioned to project outward from the intermediate section and to extend at least partially from a space between the person's thighs.

The foregoing and other objects, features, and advantages of the invention will be apparent from the following, more particular description of the preferred embodiments of the invention, as illustrated in the accompanying drawings.

DETAILED DESCRIPTION OF THE PREFERRED EMBODIMENTS

Figure 1:
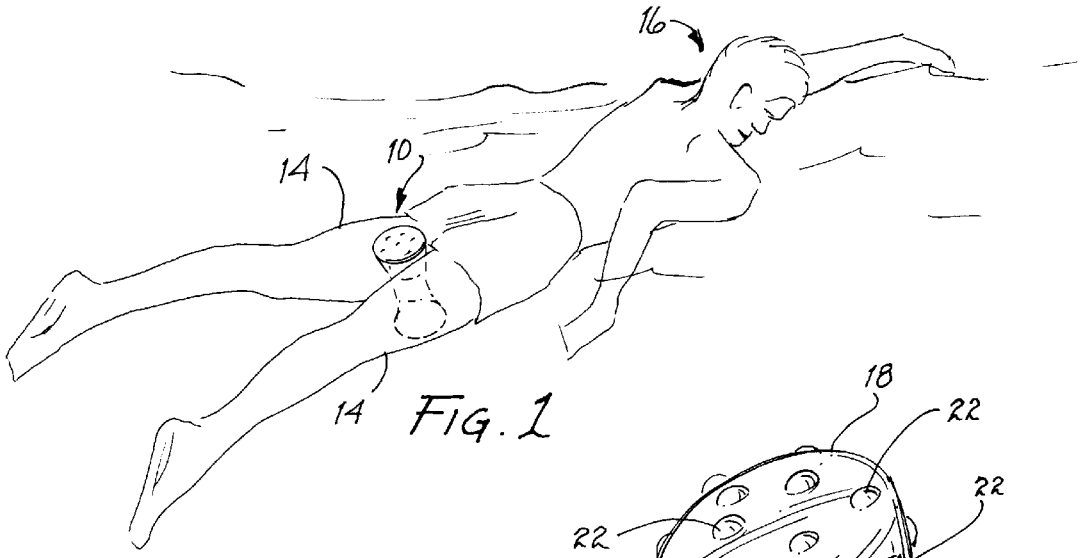
FIG. 1 is a perspective view of the preferred embodiment of the aquatic exercise device of the present invention, wherein the aquatic exercise device (shown partially in phantom) is retained between a swimmer's thighs.

Referring to FIGS. 1, 2, 3 and 4, reference number 10 refers generally to the preferred embodiment of the aquatic exercise device of the present invention. The aquatic exercise device 10 generally comprises an intermediate section 12, having a first end and a second end. The intermediate section 12 is dimensioned to be retained between the thighs 14 of a person 16 while the person 16 is swimming.

Figure 2:
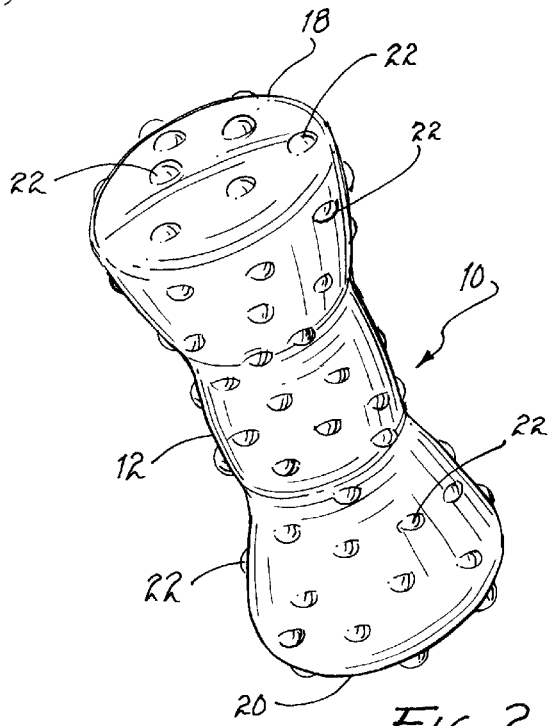
FIG. 2 is a perspective view of an embodiment of the aquatic exercise device of the present invention.
Figure 3:
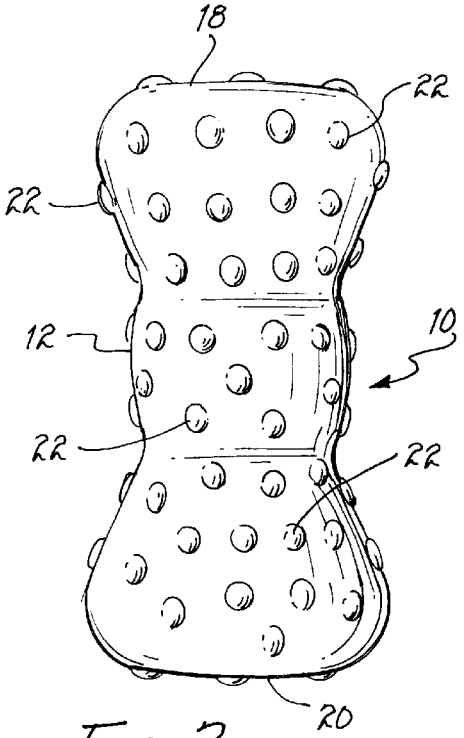
FIG. 3 is a side view of FIG. 2.
Figure 4:
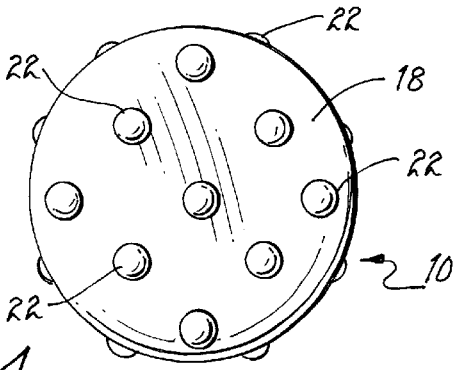
FIG. 4 is a top view of FIG. 2.

Referring now to FIGS. 2–4, the aquatic exercise device 10 further comprises a first outer section 18 which is attached to the first end of the intermediate section 12. At least a portion of the first outer section 18 has a width greater than a width of the intermediate section 12. The first outer section 18 is dimensioned to project outward from the intermediate section 12, extending at least partially from a space between a person's thighs 14.

The aquatic exercise device 10 further comprises a second outer section 20 which is attached to the second end of the intermediate section 12. Like the first outer section 18, at least a portion of the second outer section 20 has a width greater than a width of the intermediate section 12. The second outer section 20 is dimensioned to project outward from the intermediate section 12, extending at least partially from a space between a person's thighs 14. In the preferred embodiment, the intermediate section 12, the first outer section 18 and the second outer section 20 comprise a one piece assembly. The aquatic exercise device 10 is preferably comprised of a resilient material, which will substantially retain its shape during use while allowing some give during use. In this regard, a foam-type material may be used though an outer shell filled with a gel, water, air, or some combination thereof is preferred. In the preferred embodiment, the aquatic exercise device 10 is substantially hour-glass shaped, however it should be clearly understood that any shape that creates a body to be retained between legs while swimming, such as cylindrically shaped with straps, will be within the spirit and scope of this invention.

Still referring to FIGS. 2–4, the aquatic exercise device 10 preferably comprises a plurality of protrusions 22 on a surface of each of the intermediate section 12, the first outer section 18 and the second outer section 20. The protrusions 22 are designed to assist the swimmer 16 in gripping the aquatic exercise device 10 between the thighs 14- While, in the preferred embodiment, the aquatic exercise device 10 comprises a plurality of protrusions 22, it should be clearly understood that substantial benefit could be derived from a configuration of the aquatic exercise device 10 lacking protrusions 22 altogether.

STATEMENT OF OPERATION

In order to make use of the aquatic exercise device 10, the swimmer 16 places the intermediate section 12 of the aquatic exercise device 10 between his or her thighs 14. In doing so, both the first outer section 18 and the second outer section 20 should project vertically from the intermediate section 12, each extending at least partially from a space between a person's thighs 14. Preferably, the thighs 14 can also grip the protrusions 22 to better secure the aquatic exercise device 10 in place while swimming.

The swimmer 16 then begins to swim, taking care to squeeze his or her thighs 14 during the swimming. The swimmer 16 must keep the aquatic exercise device 10 squeezed into place between the thighs 14 during the butterfly, backstroke, breaststroke, freestyle, and other swimming strokes where the thighs 14 can be kept close together, in order to build strength, mobility, and flexibility in the lower body of the swimmer 16. If, during swimming, the aquatic exercise device 10 slips out of its place between the thighs 14, then the swimmer 16 must reinsert the aquatic exercise device 10 between his or her thighs 14 and continue swimming.

While the invention has been particularly shown and described with reference to preferred embodiments thereof, it will be understood by those skilled in the art that the foregoing and other changes in form and details may be made therein without departing from the spirit and scope of the invention.

I claim:

1. An aquatic exercise device comprising, in combination:

an intermediate section having a first end and a second end, said intermediate section is comprised of a resilient material and is dimensioned to be retained between a person's thighs while the person is swimming;

a first outer section attached to said first end, at least a portion of said first outer section has a width greater than a width of said intermediate section, said first outer section is dimensioned to project outward from said intermediate section and to extend at least partially from a space between said person's thighs;

a second outer section attached to said second end, at least a portion of said second outer section has a width greater than a, width of said intermediate section, said second outer section is dimensioned to project outward from said intermediate section and to extend at least partially from a space between said person's thighs; and wherein said device is configured as shown in FIG. 3.

2. A method for aquatic exercise comprising, in combination, the steps of:

providing an intermediate section having a first end and a second end, said intermediate section is comprised of a resilient material;

retaining said intermediate section between a person's thighs while said person is swimming;

providing a first outer section attached to said first end, at least a portion of said first outer section has a width greater than a width of said intermediate section, said first outer section is dimensioned to project outward from said intermediate section and to extend at least partially from a space between said person's thighs;

providing a second outer section attached to said second end, at least a portion of said second outer section has a width greater than a width of said intermediate section, said second outer section is dimensioned to project outward from said intermediate section and to extend at least partially from a space between said person's thighs.

3. The method of claim 2 wherein said intermediate section, said first outer section and said second outer section comprise a one piece assembly.

4. The method of claim 2 wherein each of said intermediate section, said first outer section and said second outer section is comprised of a foam-type material.

5. The method of claim 2 further comprising a plurality of protrusions on a surface of each of said intermediate section and said first outer section and said second outer section.

6. The method of claim 2 wherein said device is configured as shown in FIG. 3.

* * * * *